US006483464B2

(12) United States Patent
Rawnick et al.

(10) Patent No.: US 6,483,464 B2
(45) Date of Patent: Nov. 19, 2002

(54) PATCH DIPOLE ARRAY ANTENNA INCLUDING A FEED LINE ORGANIZER BODY AND RELATED METHODS

(75) Inventors: James Joseph Rawnick, Palm Bay; Randy Eugene Boozer; Robert Charles Taylor, both of Melbourne; William Edward Clark; Gilbert Reeves Perkins, both of Palm Bay, all of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/892,709

(22) Filed: Jun. 28, 2001

(65) Prior Publication Data

US 2002/0050950 A1 May 2, 2002

Related U.S. Application Data

(63) Continuation-in-part of application No. 09/702,712, filed on Oct. 31, 2000.

(51) Int. Cl.[7] ..... H01Q 1/38

(52) U.S. Cl. ..... 343/700 MS; 343/893; 343/824

(58) Field of Search ..... 343/700 MS, 824, 343/893, 797, 725, 729, 845

(56) References Cited

U.S. PATENT DOCUMENTS

| | | | | |
|---|---|---|---|---|
| 3,995,277 A | | 11/1976 | Olyphant, Jr. | 343/846 |
| 4,131,896 A | | 12/1978 | Miller | 343/815 |
| 4,173,019 A | | 10/1979 | Williams | 343/700 |
| 4,575,725 A | | 3/1986 | Tresselt | 343/700 |
| 5,229,782 A | | 7/1993 | Hemmie et al. | 343/795 |
| 5,280,297 A | * | 1/1994 | Profera, Jr. | 343/754 |
| 5,293,175 A | | 3/1994 | Hemmie et al. | 343/795 |
| 5,387,919 A | | 2/1995 | Lam et al. | 343/821 |
| 5,561,437 A | | 10/1996 | Phillips et al. | 343/702 |
| 6,069,590 A | | 5/2000 | Thompson, Jr. et al. | 343/795 |
| 6,211,824 B1 | * | 4/2001 | Holden et al. | 343/700 MS |

* cited by examiner

*Primary Examiner*—Don Wong
*Assistant Examiner*—James Clinger
(74) *Attorney, Agent, or Firm*—Allen, Dyer, Doppelt, Milbrath & Gilchrist, P.A.

(57) ABSTRACT

An antenna includes a substrate including a ground plane and a dielectric layer adjacent thereto and at least one antenna unit carried by the substrate. The at least one antenna unit may include a plurality of adjacent antenna elements arranged in spaced apart relation from one another about a central feed position on the dielectric layer opposite the ground plane. The at least one antenna unit may also include an antenna feed structure including a respective coaxial feed line for each antenna element and a feed line organizer body having passageways therein for receiving respective coaxial feed lines.

38 Claims, 3 Drawing Sheets

PATCH DIPOLE ARRAY ANTENNA INCLUDING A FEED LINE ORGANIZER BODY AND RELATED METHODS

RELATED APPLICATION

The present application is a continuation-in-part of U.S. application Ser. No. 09/702,712, filed Oct. 31, 2000.

FIELD OF THE INVENTION

The present invention relates to the field of communications, and more particularly, to phased array antennas.

BACKGROUND OF THE INVENTION

Existing microwave antennas include a wide variety of configurations for various applications, such as satellite reception, remote broadcasting, or military communication. The desirable characteristics of low cost, light-weight, low profile and mass producibility are provided in general by printed circuit antennas wherein flat conductive elements are spaced from a single essentially continuous ground element by a dielectric sheet of uniform thickness. The antennas are designed in an array and may be used for communication systems such as identification of friend/foe (IFF) systems, personal communication service (PCS) systems, satellite communication systems, and aerospace systems, which require such characteristics as low cost, light weight, low profile, and a low sidelobe.

The bandwidth and directivity capabilities of such antennas, however, can be limiting for certain applications such as space applications. Furthermore, while a microstrip patch antenna is advantageous in applications requiring a conformal configuration, e.g. in aerospace systems, mounting the antenna presents challenges with respect to the manner in which it is fed such that conformality and satisfactory radiation coverage and directivity are maintained and losses to surrounding surfaces are reduced.

More specifically, increasing the bandwith of a phased array antenna with a wide scan angle is conventionally achieved by dividing the frequency range into multiple bands. This approach results in a considerable increase in the size and weight of the antenna while creating a Radio Frequency (RF) interface problem. Also, gimbals have been used to mechanically obtain the required scan angle. Again, this approach increases the size and weight of the antenna, and results in a slower response time.

Additionally, prior art phased array antennas often have an antenna feed structure including coaxial feed lines to be connected to the various antenna elements. These coaxial feed lines are typically parallel to a common axis and soldered together to form the antenna feed structure. The feed structure is inserted through the antenna's substrate for connection with the antenna elements. Yet, it may be difficult to properly ground such antenna feed structures while connecting them to the antenna elements, which may result in undesirable common mode currents, for example.

Thus, there is a need for a lightweight patch dipole phased array antenna with a wide frequency bandwith and a wide scan angle, and that can be conformally mountable to a surface.

SUMMARY OF THE INVENTION

In view of the foregoing background, it is therefore an object of the invention to provide a lightweight patch dipole phased array antenna with a wide frequency bandwith and a wide scan angle, and that can be conformally mountable to a surface.

This and other objects, features and advantages in accordance with the present invention are provided by an antenna including a substrate including a ground plane and a dielectric layer adjacent thereto and at least one antenna unit carried by the substrate. The at least one antenna unit may include a plurality of adjacent antenna elements arranged in spaced apart relation from one another about a central feed position on the dielectric layer opposite the ground plane. The at least one antenna unit may also include an antenna feed structure including a respective coaxial feed line for each antenna element and a feed line organizer body having passageways therein for receiving respective coaxial feed lines.

More specifically, the feed line organizer body may include a base connected to the ground plane and a guide portion carried by the base. The base and the guide portion may be integrally formed as a monolithic unit, for example. Moreover, the guide portion may include a bottom enclosed guide portion carried by the base, a top enclosed guide portion adjacent the antenna elements, and an intermediate open guide portion extending between the bottom enclosed guide portion and the top enclosed guide portion adjacent the antenna elements. Each coaxial feed line may be soldered to the feed line organizer body at the intermediate open guide portion. Furthermore, the antenna feed structure may include a tuning plate carried by the guide portion. Additionally, the passageways may each be parallel to a common axis, and the feed line organizer may include at least one conductive material, such as brass, for example.

The ground plane may extend laterally outwardly beyond a periphery of the at least one antenna unit. Also, the antenna may further include at least one hybrid circuit carried by the substrate and connected to the antenna feed structure. Each antenna element may have a generally rectangular shape, and the at least one antenna unit may include a plurality of antenna units arranged in an array. Furthermore, the dielectric layer may have a thickness in a range of about ½ an operating wavelength of the at least one antenna unit. Additionally, there may be at least one impedance matching dielectric layer on the at least one antenna unit.

A method aspect of the invention is for making an antenna and includes providing at least one antenna unit on a substrate comprising a ground plane and a dielectric layer adjacent thereto. The at least one antenna unit may include a plurality of adjacent antenna elements arranged in spaced apart relation from one another about a central feed position on the dielectric layer opposite the ground plane. Additionally, the substrate may have an opening therein exposing portions of the plurality of adjacent antenna elements. The method may further include forming an antenna feed structure by positioning respective coaxial feed lines within passageways of a feed line organizer body. Further, the antenna feed structure is inserted into the opening, and each of the coaxial feed lines is connected to a respective antenna element.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
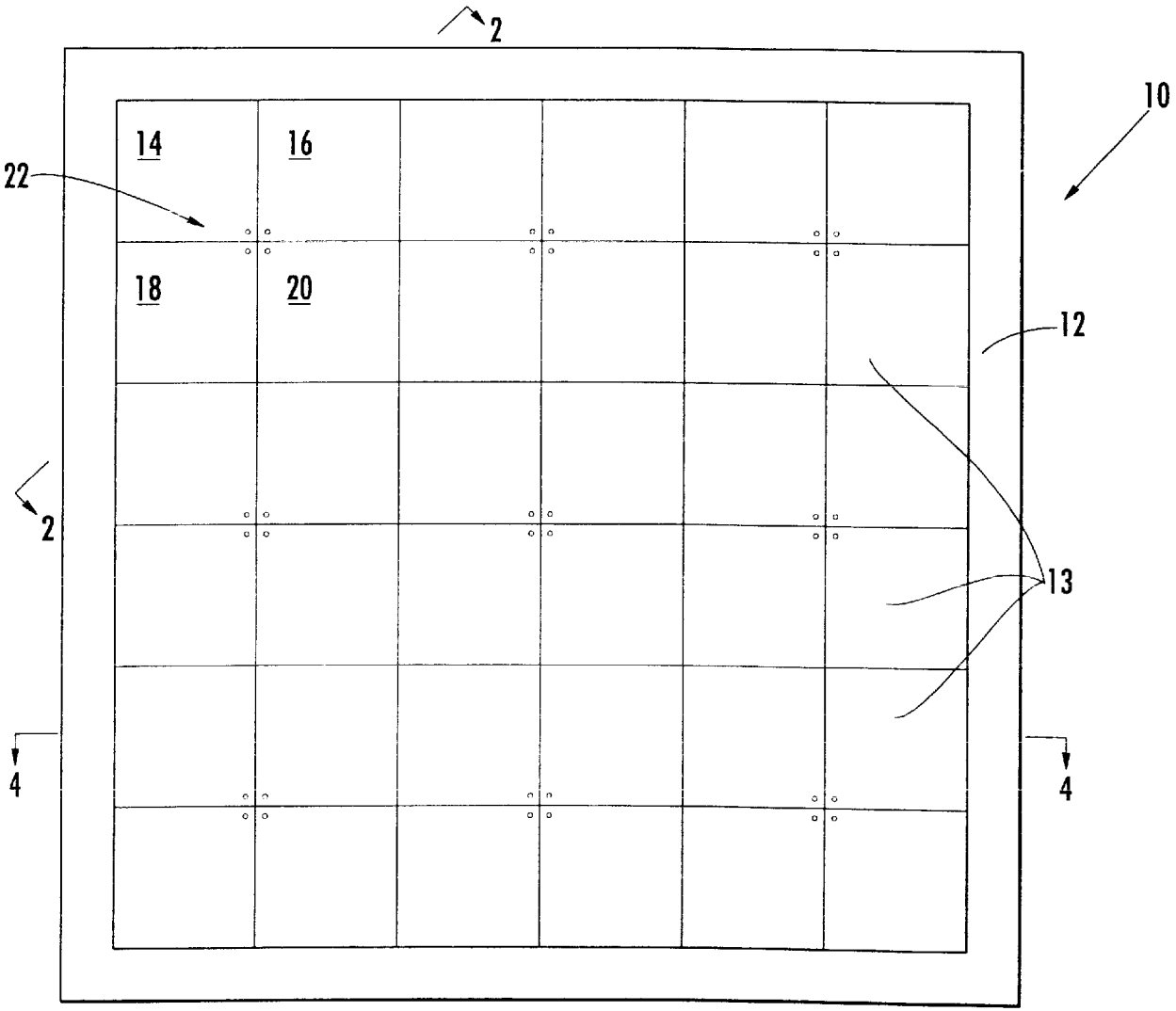
FIG. 1 is a schematic plan view of a dual polarization phased array antenna in accordance with the present invention.

Referring to FIGS. 1–4, a dual polarization antenna 10 according to the invention will now be described. The antenna 10 includes a substrate 12 having a ground plane 26 and a dielectric layer 24 adjacent thereto, and at least one antenna unit 13 carried by the substrate. Preferably, a plurality of antenna units 13 are arranged in an array. As shown in FIG. 1, the antenna 10 includes nine antenna units 13. Each antenna unit 13 includes four adjacent antenna patches or elements 14, 16, 18, 20 arranged in spaced apart relation from one another about a central feed position 22 on the dielectric layer 24 opposite the ground plane 26. Preferably, diagonal pairs of antenna elements, e.g. 16/18 and 14/20, define respective antenna dipoles thereby providing dual polarization, as would be appreciated by the skilled artisan. Of course, only a single pair of antenna elements, e.g. 16/18, forming an antenna dipole may be provided for a single polarization embodiment.

Figure 2:
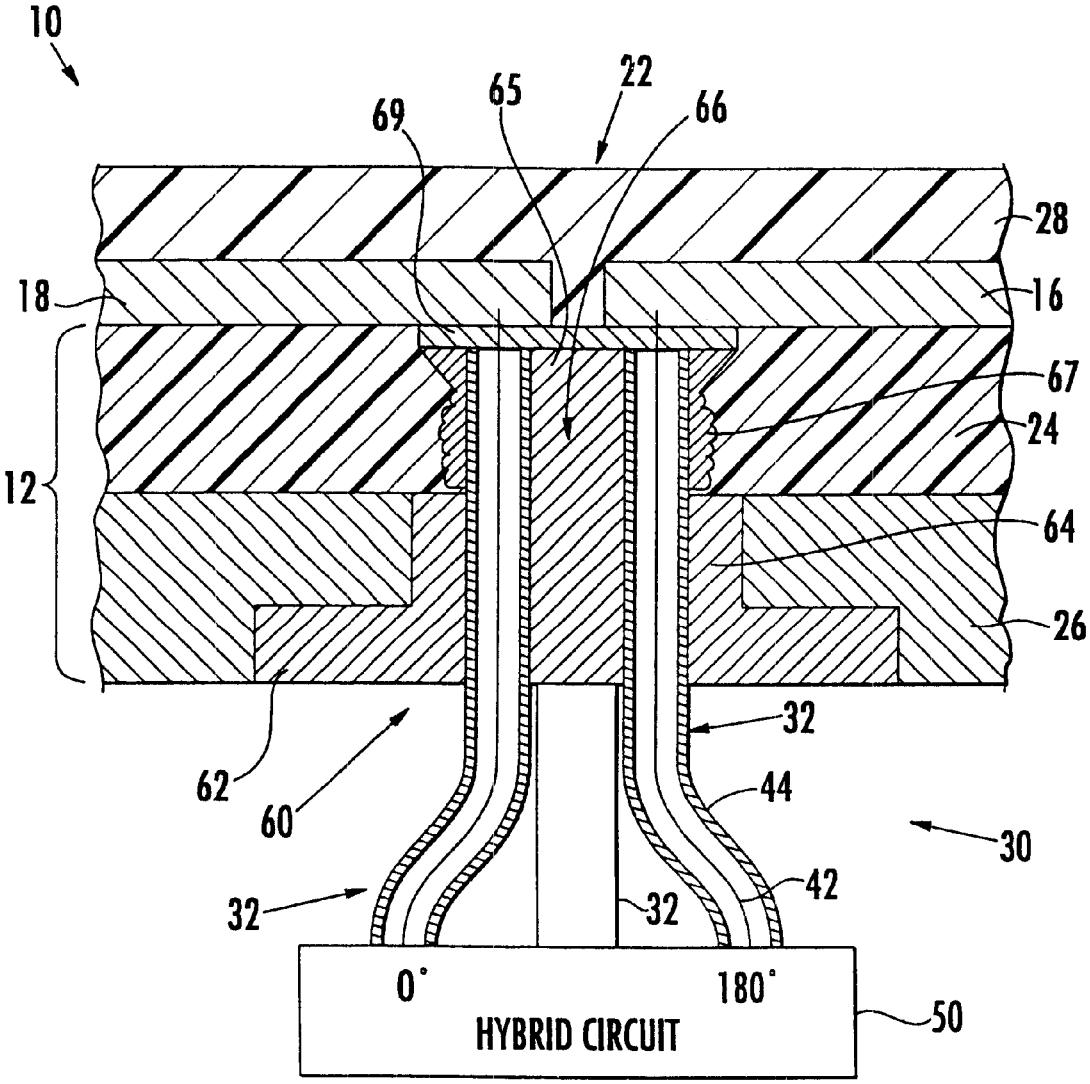
FIG. 2 is a cross-sectional view of the antenna including the antenna feed structure taken along the line 2—2 in FIG. 1.

Each antenna unit also includes an antenna feed structure 30 including four coaxial feed lines 32. Each coaxial feed line 32 has an inner conductor 42 and a tubular outer conductor 44 in surrounding relation thereto, for example (FIG. 2). The antenna feed structure 30 includes a feed line organizer body 60 having passageways 61 therein for receiving respective coaxial feed lines 32. The feed line organizer 60 is preferably integrally formed as a monolithic unit, as will be appreciated by those of skill in the art.

More specifically, the feed line organizer body 60 may include a base 62 connected to the ground plane 26 and a guide portion 63 carried by the base. The base 62 may have holes 68 therein so that the base may be connected to the ground plane 26 using screws. Of course, other suitable connectors known to those of skill in the art may also be used.

The guide portion 63 may include a bottom enclosed guide portion 64 carried by the base 62, a top enclosed guide portion 65 adjacent the antenna elements 14, 16, 18, 20, and an intermediate open guide portion 66 extending between the bottom enclosed guide portion and the top enclosed guide portion. The outer conductor 44 of each coaxial feed line 32 may be connected to the feed line organizer body 60 at the intermediate open guide portion 66 via solder 67, as illustratively shown in FIG. 2.

The feed line organizer body 60 is preferably made from a conductive material, such as brass, for example, which allows for relatively easy production and machining thereof. As a result, the antenna feed structure 30 may be produced in large quantities to provide consistent and reliable ground plane 26 connection. Of course, other suitable materials may also be used for the feed line organizer body 60, as will be appreciated by those of skill in the art.

Figure 3:
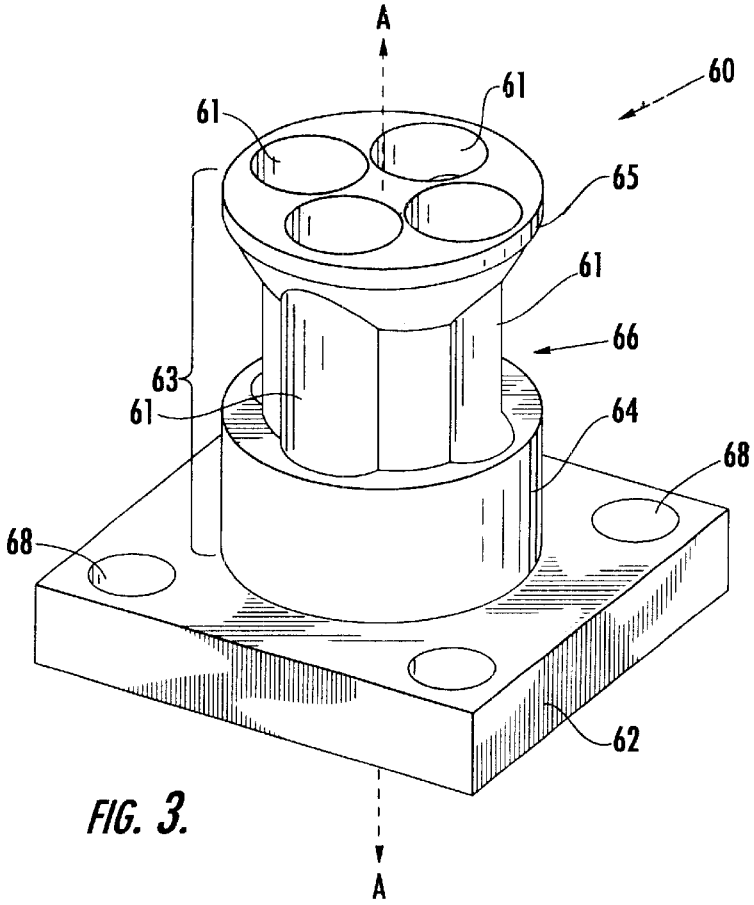
FIG. 3 is a perspective view of the feed line organizer body of the antenna feed structure of FIG. 2.

Additionally, as illustratively shown in FIG. 3, the passageways 61 are preferably parallel to a common axis A—A so that the coaxial feed lines 32 are parallel and adjacent to one another. Furthermore, the antenna feed structure 30 may advantageously include a tuning plate 69 carried by the top enclosed guide portion 65. The tuning plate 69 may be used to compensate for feed inductance, as will be appreciated by those of skill in the art.

The ground plane 26 may extend laterally outwardly beyond a periphery of the antenna units 13, and the coaxial feed lines 32 may diverge outwardly from contact with one another upstream from the central feed position 22, as can be seen in FIG. 2. The antenna 10 may also include at least one hybrid circuit 50 carried by the substrate 12 and connected to the antenna feed structure 30. The hybrid circuit 50 controls, receives and generates the signals to respective antenna elements 14, 16, 18, 20 of the antenna units 13, as would be appreciated by those skilled in the art.

Figure 4:
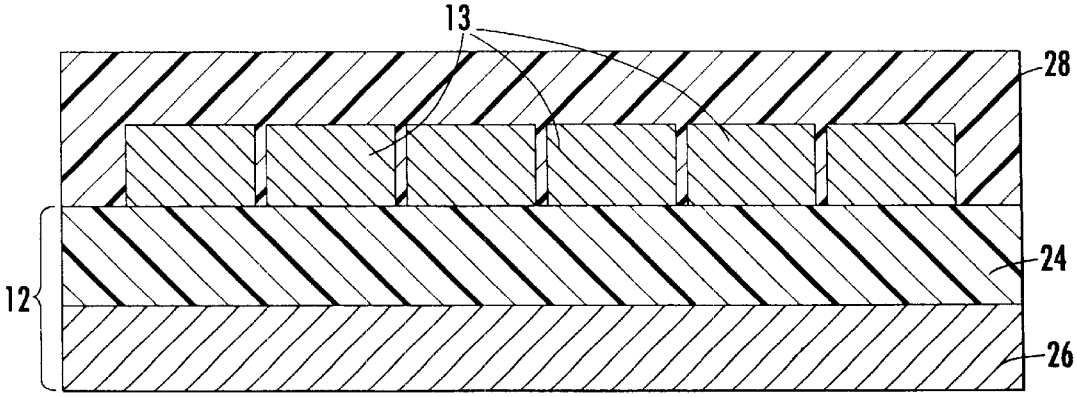
FIG. 4 is a cross-sectional view of the ground plane, dielectric layer, antenna units and impedance matching dielectric layer of the antenna taken along the line 4—4 in FIG. 1.

The dielectric layer preferably has a thickness in a range of about ½ an operating wavelength of the antenna 10, and at least one impedance matching dielectric layer 28 may be provided over the antenna units 13. This impedance matching dielectric layer 28 may also extend laterally outwardly beyond a periphery of the antenna units 13, as shown in FIG. 4. The use of the extended substrate 12 and extended impedance matching dielectric layer 28 result in an antenna bandwidth of 2:1 or greater. The substrate 12 is flexible and can be conformally mounted to a rigid surface, such as the nose-cone of an aircraft or spacecraft, for example.

A related method aspect of the invention is for making the antenna 10. The method includes providing at least one antenna unit 13 on the substrate 12, which includes the ground plane 26 and the dielectric layer 24 adjacent thereto. The at least one antenna unit 13 includes a plurality of adjacent antenna elements 14, 16, 18, 20 arranged in spaced apart relation from one another about the central feed position 22 on the dielectric layer 24 opposite the ground plane 26. As noted above, the substrate 12 includes an opening exposing portions of the antenna elements 14, 16, 18, 20.

The method further includes forming the antenna feed structure 30 by positioning respective coaxial feed lines 32 within the passageways 61 of the feed line organizer body 60, as described above. Furthermore, the method also includes inserting the antenna feed structure 30 into the opening and connecting the coaxial feed lines 32 to respective antenna elements 14, 16, 18, 20, as previously discussed above.

More specifically, the feed line organizer body 60 allows the antenna feed structure 30 to essentially be "plugged in" to the substrate 12 for relatively easy connection to the at least one antenna unit 13. The antenna feed structure 30 including the feed line organizer body 60 also allows for relatively easy removal and/or replacement without damage to the antenna 10. Moreover, common mode currents, which may result from improper grounding of the coaxial feed lines 32 may be substantially reduced using the antenna feed structure 30 including the feed line organizer body 60. That is, the intermediate open guide portion 66 thereof allows for consistent and reliable grounding of the coaxial feed lines 32.

The antenna 10 may have a two-to-one bandwidth in the frequency range of 2–28 GHz, may achieve a scan angle of ±45°, and provide return loss of less than or equal to about 10 db. Thus, a lightweight patch dipole phased array antenna 10 according to the invention with a wide frequency bandwith and a wide scan angle is provided. Also, the antenna 10 is flexible and can be conformally mountable to a surface.

Furthermore, while the antenna feed structure 30 has been described for use with the four antenna elements 14, 16, 18,

20, it will be appreciated by those of skill in the art that this feed structure is also well suited for antenna arrays with different numbers of antenna elements. Moreover, the antenna feed structure 30 may also be used with antennas other than the antennas 10 discussed herein. By way of example, the antenna feed structure 30 according to the invention is also well suited for use with antennas such as the phased array antenna disclosed in U.S. application Ser. No. 09/703,247 filed Oct. 31, 2000, and assigned to the present assignee, which is hereby incorporated herein in its entirety by reference. Application to numerous other antenna structures may also be possible, as will be appreciated by those of skill in the art.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna comprising:

a substrate comprising a ground plane and a dielectric layer adjacent thereto; and at least one antenna unit carried by said substrate comprising a plurality of adjacent antenna elements arranged in spaced apart relation from one another about a central feed position on said dielectric layer opposite said ground plane, and an antenna feed structure comprising a respective coaxial feed line for each antenna element and a feed line organizer body having passageways therein for receiving respective coaxial feed lines.

2. The antenna according to claim 1 wherein said feed line organizer body comprises:

a base connected to said ground plane; and a guide portion carried by said base, said base and guide portion being integrally formed as a monolithic unit.

3. The antenna according to claim 2 wherein said guide portion comprises:

a bottom enclosed guide portion carried by said base;

a top enclosed guide portion adjacent said antenna elements; and an intermediate open guide portion extending between said bottom enclosed guide portion and said top enclosed guide portion.

4. The antenna according to claim 3 wherein each coaxial feed line is soldered to said feed line organizer body at said intermediate open guide portion.

5. The antenna according to claim 2 wherein said antenna feed structure further comprises a tuning plate carried by said guide portion.

6. The antenna according to claim 1 wherein said passageways are all parallel to a common axis.

7. The antenna according to claim 1 wherein said feed line organizer body comprises at least one conductive material.

8. The antenna according to claim 1 wherein said ground plane extends laterally outwardly beyond a periphery of said at least one antenna unit.

9. The antenna according to claim 1 further comprising at least one hybrid circuit carried by said substrate and connected to said antenna feed structure.

10. The antenna according to claim 1 wherein each antenna element has a generally rectangular shape.

11. The antenna according to claim 1 wherein said at least one antenna unit comprises a plurality of antenna units arranged in an array.

12. The antenna according to claim 1 wherein said dielectric layer has a thickness in a range of about ½ an operating wavelength of the at least one antenna unit.

13. The antenna according to claim 1 further comprising at least one impedance matching dielectric layer on said at least one antenna unit.

14. An antenna comprising:

a substrate comprising a ground plane and a dielectric layer adjacent thereto; and at least one antenna unit carried by said substrate comprising a plurality of adjacent antenna elements arranged in spaced apart relation from one another about a central feed position on said dielectric layer opposite said ground plane, and an antenna feed structure comprising a respective coaxial feed line for each antenna element and a feed line organizer body having passageways therein for receiving respective coaxial feed lines, said passageways all being parallel to a common axis and said feed line organizer body being integrally formed as a monolithic unit.

15. The antenna according to claim 14 wherein said feed line organizer body comprises:

a base connected to said ground plane; and a guide portion carried by said base.

16. The antenna according to claim 15 wherein said guide portion comprises:

a bottom enclosed guide portion carried by said base;

a top enclosed guide portion adjacent said antenna elements; and an intermediate open guide portion extending between said bottom enclosed guide portion and said top enclosed guide portion.

17. The antenna according to claim 16 wherein each coaxial feed line is soldered to said feed line organizer body at said intermediate open guide portion.

18. The antenna according to claim 15 wherein said antenna feed structure further comprises a tuning plate carried by said guide portion.

19. The antenna according to claim 14 wherein said feed line organizer comprises at least one conductive material.

20. The antenna according to claim 14 wherein said ground plane extends laterally outwardly beyond a periphery of said at least one antenna unit.

21. The antenna according to claim 14 further comprising at least one hybrid circuit carried by said substrate and connected to said antenna feed structure.

22. The antenna according to claim 14 wherein each antenna element has a generally rectangular shape.

23. The antenna according to claim 14 wherein said at least one antenna unit comprises a plurality of antenna units arranged in an array.

24. The antenna according to claim 14 wherein said dielectric layer has a thickness in a range of about ½ an operating wavelength of the at least one antenna unit.

25. The antenna according to claim 14 further comprising at least one impedance matching dielectric layer on said at least one antenna unit.

26. A method for making an antenna comprising:

providing at least one antenna unit on a substrate comprising a ground plane and a dielectric layer adjacent thereto, the at least one antenna unit comprising a plurality of adjacent antenna elements arranged in spaced apart relation from one another about a central feed position on the dielectric layer opposite the ground plane, the substrate having an opening therein exposing portions of the plurality of adjacent antenna elements;

forming an antenna feed structure by positioning respective coaxial feed lines within passageways of a feed line organizer body; and inserting the antenna feed structure into the opening and connecting each of the coaxial feed lines to a respective antenna element.

27. The method according to claim 26 wherein the feed line organizer body comprises a base and a guide portion carried by the base, the base and guide portion being integrally formed as a monolithic unit; and wherein inserting the antenna feed structure into the opening comprises connecting the base to the ground plane and connecting each coaxial cable to a respective antenna element.

28. The method according to claim 27 wherein the guide portion comprises:

a bottom enclosed guide portion carried by the base;

a top enclosed guide portion to be positioned adjacent the antenna elements; and an intermediate open guide portion extending between the bottom enclosed guide portion and the top enclosed guide portion.

29. The method according to claim 28 wherein forming the antenna feed structure further comprises soldering each coaxial feed line to the feed line organizer body at the intermediate open guide portion.

30. The method according to claim 27 wherein forming the antenna feed structure further comprises connecting a tuning plate to the guide portion.

31. The method according to claim 26 wherein the passageways are each parallel to a common axis.

32. The method according to claim 26 wherein the feed line organizer comprises at least one conductive material.

33. The method according to claim 26 wherein the ground plane extends laterally outwardly beyond a periphery of the at least one antenna unit.

34. The method according to claim 26 further comprising providing at least one hybrid circuit on the substrate and connected to the antenna feed structure.

35. The method according to claim 26 wherein each antenna element has a generally rectangular shape.

36. The method according to claim 26 wherein providing the at least one antenna unit comprises arranging a plurality of antenna units in an array.

37. The method according to claim 26 wherein the dielectric layer has a thickness in a range of about ½ an operating wavelength of the at least one antenna unit.

38. The method according to claim 26 further comprising providing at least one impedance matching dielectric layer on the at least one antenna unit.

* * * * *

UNITED STATES PATENT AND TRADEMARK OFFICE

CERTIFICATE OF CORRECTION

PATENT NO. : 6,483,464 B2
DATED : November 19, 2002
INVENTOR(S) : James Joseph Rawnick et al.

It is certified that error appears in the above-identified patent and that said Letters Patent is hereby corrected as shown below:

Title page,
Item [75], Inventors, delete "James Joseph Rawnick, Palm Bay; Randy Eugene Boozer; Robert Charles Taylor, both of Melbourne; William Edward Clark; Gilbert Reeves Perkins, both of Palm Bay, all of FL (US)" insert -- James Joseph Rawnick, Palm Bay; Randy Eugene Boozer; Robert Charles Taylor, both of Melbourne; William Edward Clark; Gilbert Reeves Perkins, both of Palm Bay; Douglas E. Heckaman, Indialantic, all of FL (US) --

Signed and Sealed this

Seventh Day of October, 2003

JAMES E. ROGAN
*Director of the United States Patent and Trademark Office*